US007750800B2

(12) United States Patent
Wu

(10) Patent No.: US 7,750,800 B2
(45) Date of Patent: Jul. 6, 2010

(54) PATROL SYSTEM AND PATROL METHOD THEREOF

(75) Inventor: Sun-Li Wu, Tainan (TW)

(73) Assignees: Kao Yuan University, Kaohsiung County (TW); Going Technology Co., Ltd., Tainan (TW)

( * ) Notice: Subject to any disclaimer, the term of this patent is extended or adjusted under 35 U.S.C. 154(b) by 426 days.

(21) Appl. No.: 11/779,269

(22) Filed: Jul. 17, 2007

(65) Prior Publication Data

US 2008/0030364 A1 Feb. 7, 2008

(30) Foreign Application Priority Data

Aug. 2, 2006 (TW) ..... 95128325 A

(51) Int. Cl.
*G08B 1/08* (2006.01)

(52) U.S. Cl. ..... 340/539.13; 340/539.11

(58) Field of Classification Search ..... 340/539.1, 340/539.11, 539.13, 539.14, 505, 572.1, 340/573.1, 573.4, 10.1, 10.41, 825.49; 235/384, 235/385; 702/187
See application file for complete search history.

(56) References Cited

U.S. PATENT DOCUMENTS 6,396,413 B2 * 5/2002 Hines et al. ..... 340/825.49
6,720,888 B2 * 4/2004 Eagleson et al. ..... 340/905
6,834,259 B1 * 12/2004 Markwitz et al. ..... 702/187
7,363,196 B2 * 4/2008 Markwitz et al. ..... 702/187
2006/0053378 A1 * 3/2006 Fano et al. ..... 715/747
2006/0267731 A1 * 11/2006 Chen ..... 340/10.1
2007/0120650 A1 * 5/2007 Nagai et al. ..... 340/10.2

* cited by examiner

*Primary Examiner*—Van T. Trieu
(74) *Attorney, Agent, or Firm*—Banger Shia

(57) ABSTRACT

A patrol system comprises: a computer, a receiving and sending communication device, and a plurality of signal elements. The computer and the receiving and sending communication device are wirelessly connected to each other. The receiving and sending communication device serves to sense the signal elements. The signal elements are disposed at designated patrol locations. When a patrolman with a receiving and sending communication device arrives at a designated patrol location and gives feedback to the computer, the computer will determine next patrol location to be patrolled and inform the patrolman. And thus the patrol route of each patrolman is determined randomly by the computer, so that the thief doesn't know the patrol route. Further, even the patrolman doesn't know the next patrol location to be patrolled, thus preventing the patrolman from colluding with the thief and betraying the patrol route.

1 Claim, 5 Drawing Sheets

PATROL SYSTEM AND PATROL METHOD THEREOF

BACKGROUND OF THE INVENTION

1. Field of the Invention

The present invention relates to a patrol system, and more particularly to a patrol system and patrol method thereof, which is capable of monitoring the position of the patrolman in a real time manner, and randomly determining the patrol locations and the patrol route, thus preventing the thief from knowing the patrol route, and preventing the patrolman from colluding with the thief and betraying the patrol route.

2. Description of the Prior Art

The patrolmen of the current military or police unit or security company usually patrol along a fixed route, and the method for inspecting whether the patrolmen has arrived the patrol locations is to set a box in each of the patrol locations, and in the box is placed a book, and the patrolman has to sign his name on the book when he arrives at the patrol location. However, it is quite inconvenient for the patrolman on a patrol car since he has to get off the car to sign his name on the book. Further, the box is of open type, and everybody can read the book, therefore, it will be a safety problem if a thief spies into the patrol route and time from the book.

To solve the disadvantage of the signature book, GPS and wireless communication technique are utilized to monitor the patrolman's position and the patrol route, which is convenient and secret. However, this method of using GPS and wireless communication technique is expensive and the GPS is not workable inside a building since satellite signal cannot be received.

Therefore, a RFID (radio frequency identification) patrol system appears on the market, such as the patrol system and method disclosed in TW Pt No 092136777, as shown in FIG. 1, which comprises a plurality of frequency identification labels 10 and a reorder 11. Each of the frequency identification labels 10 is provided with a memory 101, and at each patrol location is arranged a frequency identification label 10. When a patrolman is on patrol with a recorder 11, the recorder 11 keeps sending out electromagnetic wave intermittently, and after the frequency identification label 10 receives the electromagnetic wave, the patrol record will be saved in the memory 101 of the frequency identification label 10. This frequency identification method is more convenient and quick as compared with the signature book. Further, since the patrol record is recorded in the frequency identification label 10, this method prevents the probability of tampering and falsification and can also prevent the thief from spying on the patrol record from the signature book. In addition, the frequency identification method is cheaper than GPS and can be used inside and outside a building. But this patrol system is unable to realtime monitor the position of the patrolman, and the patrol record is only available after the event. In addition, the patrol route is fixed, so if the patrolman colluded with the thief and betrays the patrol route, or if the thief spied out the route after a long time of observation, the patrol will be nothing but an empty shell no matter how many or how often patrols are carried out.

The present invention has arisen to mitigate and/or obviate the afore-described disadvantages.

SUMMARY OF THE INVENTION

The primary objective of the present invention is to provide a patrol system which is capable of monitoring the position of the patrolman.

To achieve the above objective, a patrol system in accordance with the present invention comprises: a computer, a receiving and sending communication device, and a plurality of signal elements. The computer and the receiving and sending communication device are wirelessly connected to each other (such as GSM/GPRS communication techniques). The receiving and sending communication device serves to sense the signal elements. The signal elements are disposed at designated patrol locations. The receiving and sending communication device senses the signal elements and gives feedback to the computer, allowing the computer to monitor the position of the patrolman. If the patrolman failed to arrive at the designated location within the predetermined time, the person in charge of the computer can contact the patrolman. If the patrolman doesn't respond or something goes wrong, problems can be settled immediately.

The secondary objective of the present invention is to provide a patrol method which is able to change the patrol route randomly. When a patrolman with a receiving and sending communication device arrives at a designated patrol location and gives feedback to the computer, the computer will determine next patrol location to be patrolled and inform the patrolman. And thus the patrol route of each patrolman is determined randomly by the computer, so that the thief doesn't know the patrol route. Further, even the patrolman doesn't know the next patrol location to be patrolled, thus preventing the patrolman from colluding with the thief and betraying the patrol route.

DETAILED DESCRIPTION OF THE PREFERRED EMBODIMENT

The present invention will be the clearer from the following description when viewed together with the accompanying drawings, which show, for purpose of illustrations only, the preferred embodiment in accordance with the present invention.

Figure 1:
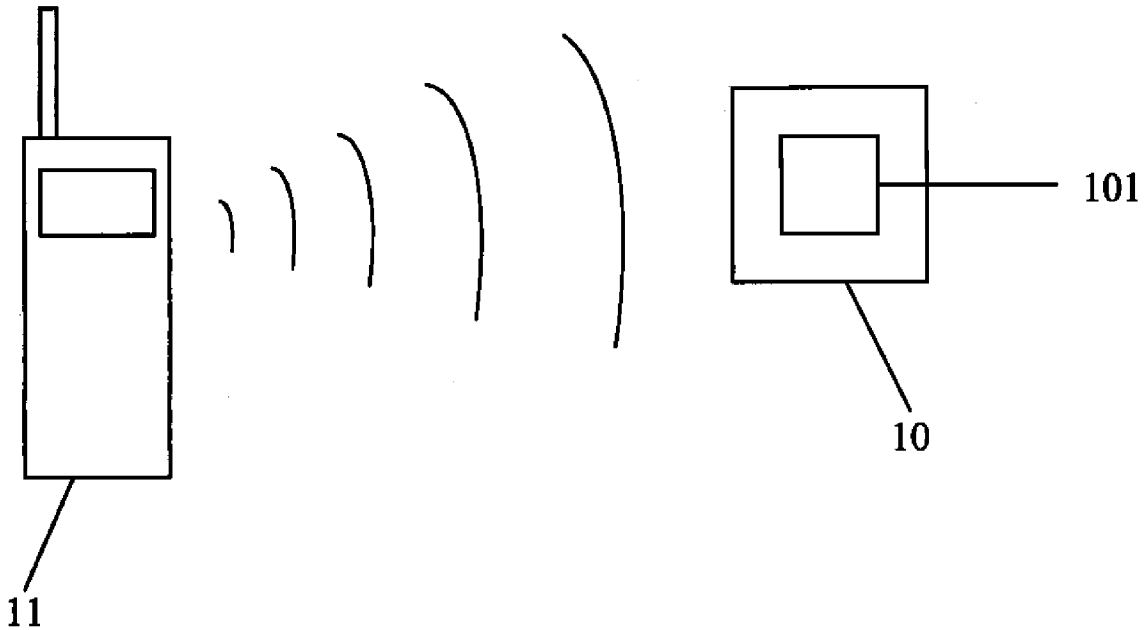
FIG. 1 PRIOR ART
FIG. 1 is an illustrative view of a conventional patrol system.
Figure 2:
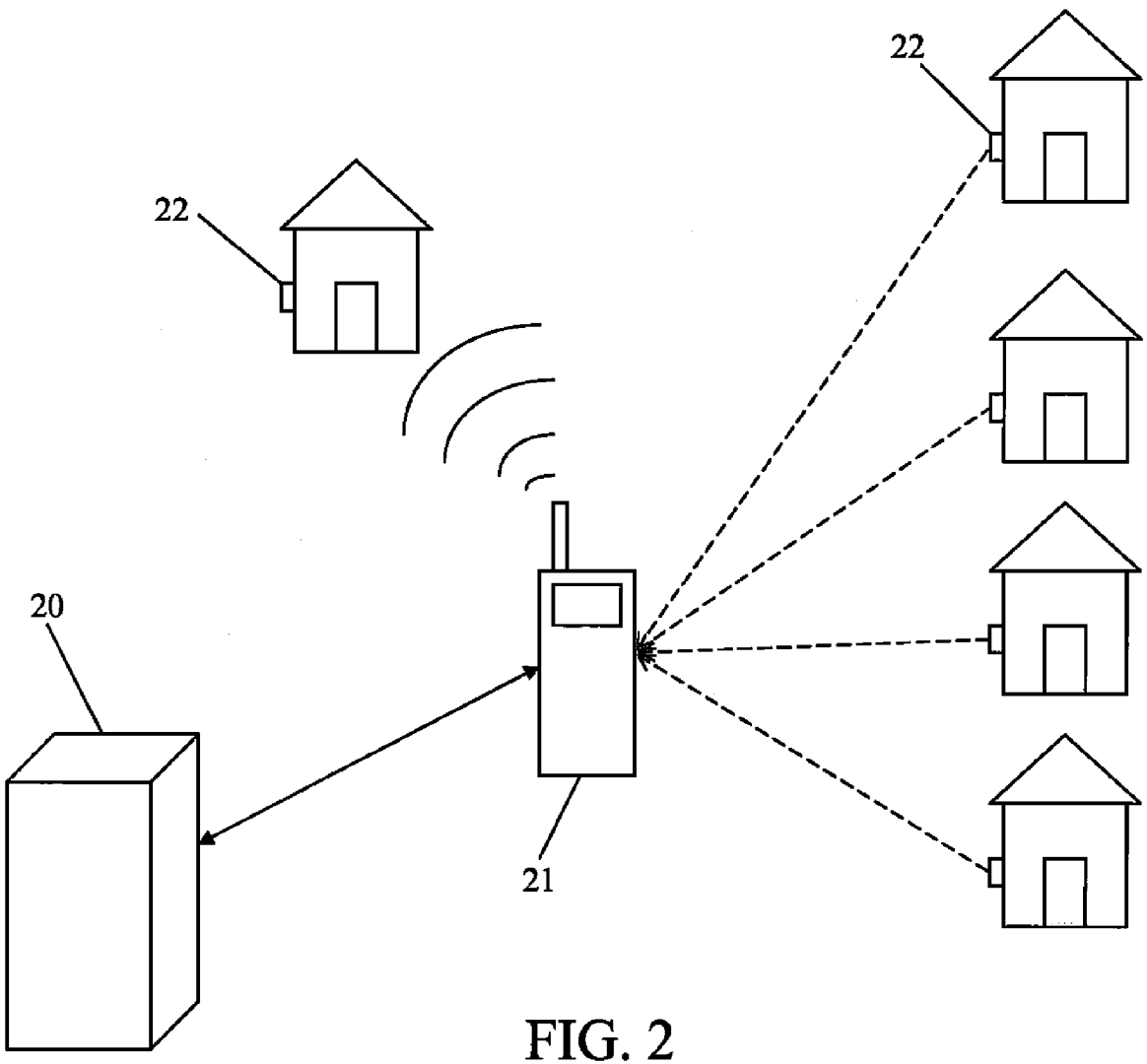
FIG. 2 is an operational view of a patrol system in accordance with the present invention.
Figure 3:
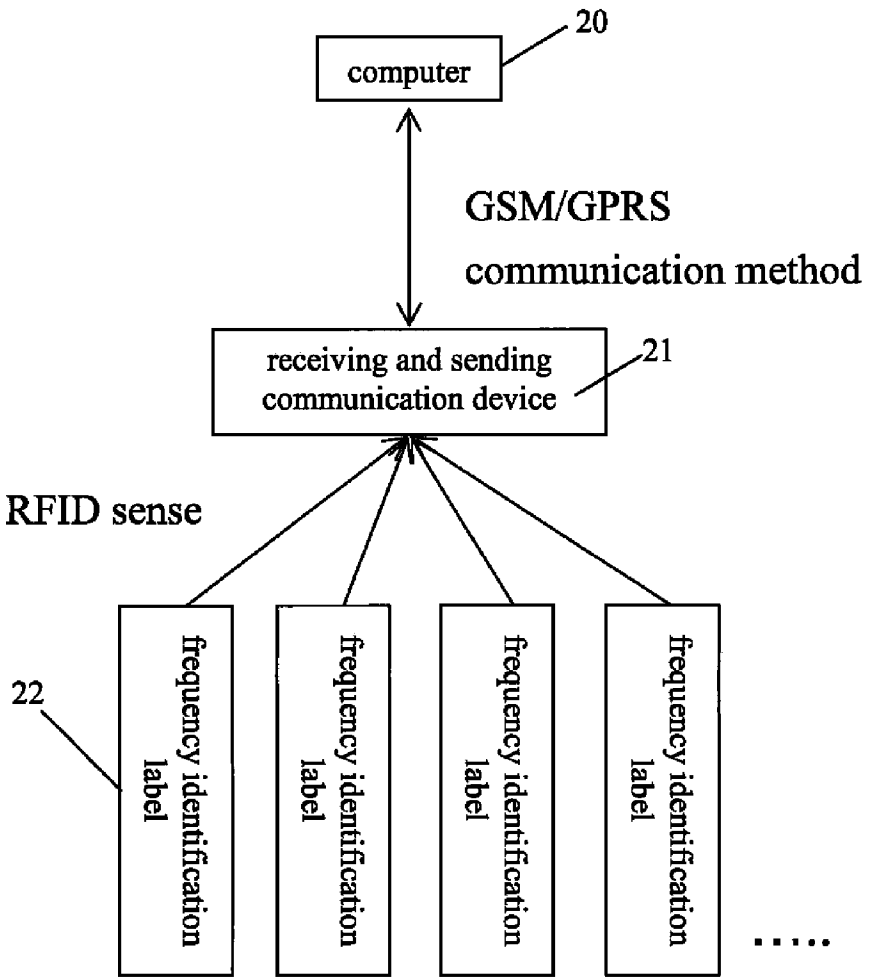
FIG. 3 is a systematic view of the patrol system in accordance with the present invention.
Figure 4:
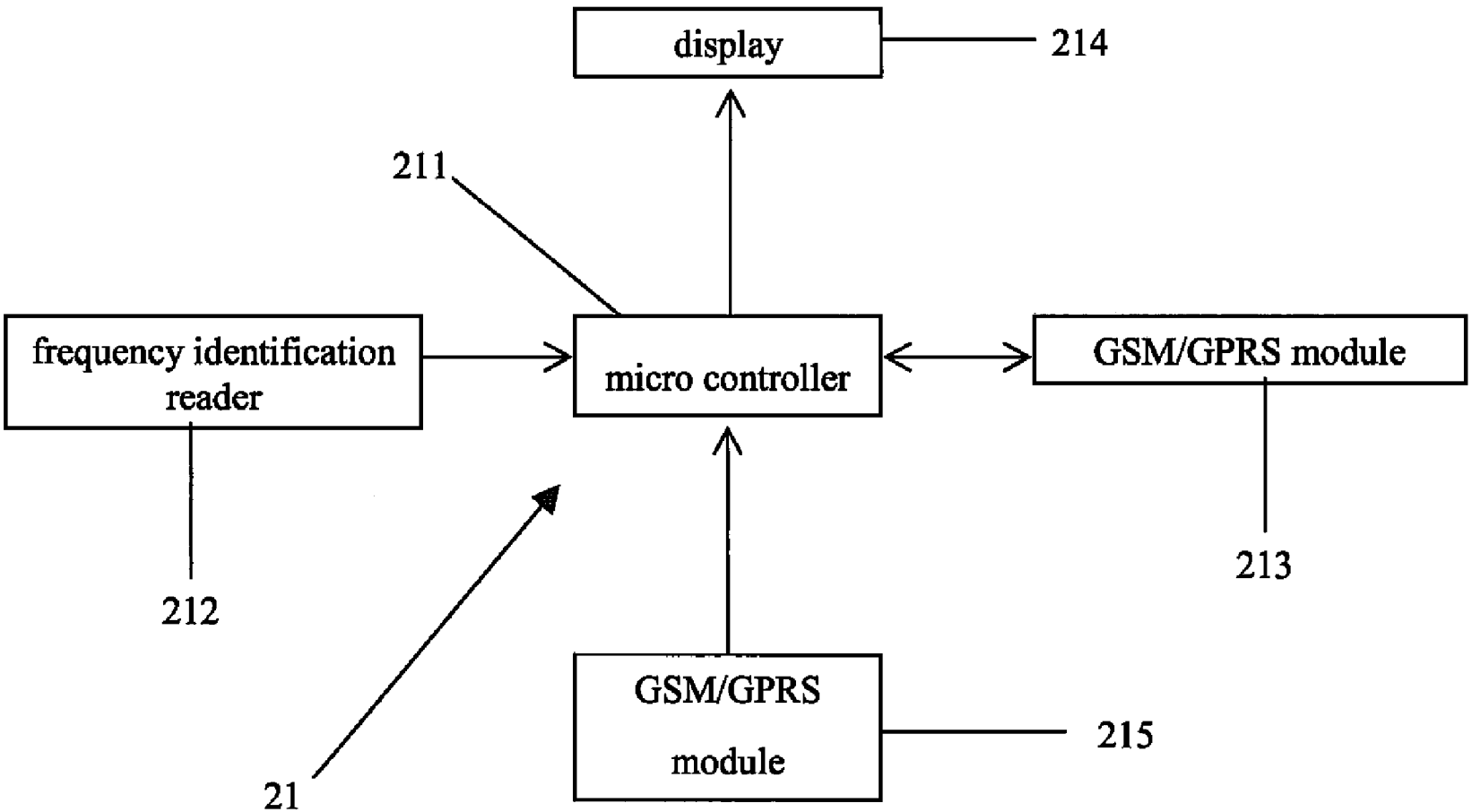
FIG. 4 is a systematic view of a receiving and sending communication device in accordance with the present invention.

Referring to FIGS. 2 and 3, a patrol system in accordance with the present invention comprises: a computer 20, a receiving and sending communication device 21, and a plurality of frequency identification labels 22 (the frequency identification label is an embodiment of a signal element). The computer 20 is connected to the receiving and sending communication device 21 via GSM (global system for mobile communications) or GPRS (general packet radio service). The receiving and sending communication device 21 serves to sense the frequency identification labels 22 via RFID. The receiving and sending communication device 21 includes a micro controller 211, a frequency identification reader 212, a GSM/GPRS module 213, a display 214 and a keyboard 215. As shown in FIG. 4, the micro controller 211 is the core of the receiving and sending communication device 21 and is connected to the frequency identification reader 212, the GSM/

GPRS module 213, the display 214 and the keyboard 215, respectively. The receiving and sending communication device 21 establishes communication with the frequency identification labels 22 via the frequency identification reader 212 and is wirelessly connected to the computer 20 via the GSM/GPRS module 213. The display 214 is controlled by the micro controller 211 and serves to display data. The keyboard 215 controls the receiving and sending communication device 21 and serves to edit the data. The frequency identification labels 22 are disposed at the respective patrol locations and contain the information and data of the patrol locations. The communication methods between the receiving and sending communication device 21 and the computer 20 can also be of any wireless communication types in addition to the GSM/GPRS as stated above.

When a patrolman with the receiving and sending communication device 21 arrives at a patrol location, the frequency identification reader 212 of the receiving and sending communication device 21 will sense the frequency identification labels 22 immediately, and the receiving and sending communication device 21 will read the data of the frequency identification labels 22. After the micro controller 211 processes the data of the patrol location, the display 214 will display the patrol record, and meanwhile, the GSM-GPRS module 213 will transmit the patrol record to the computer 20. The patrol system and its operation procedure are as mentioned above. And the patrol method comprises the steps:

After receiving the patrol record from the receiving and sending communication device 21, the computer 20 will randomly determine the next location to be patrolled based on the following principles.

A. The next location to be patrolled should be neighboring to the patrol location which is now being patrolled.

B. The next location to be patrolled can be the location which has been patrolled, and the probability of patrolling the patrolled locations is comparatively low and the probability of patrolling the non-patrolled locations is relatively high.

C. the probabilities of patrolling are also different from specific patrolled location to specific patrolled location, the longer the time has passed since a location was patrolled, the more likely this location is to be patrolled, and vice versa, the shorter the time has passed since a location was patrolled, the less likely this location is to be patrolled.

D. The computer is able to predetermine some important patrol locations such that the important patrol locations are set to have a higher probability of patrolling than the general patrol locations.

Figure 5:
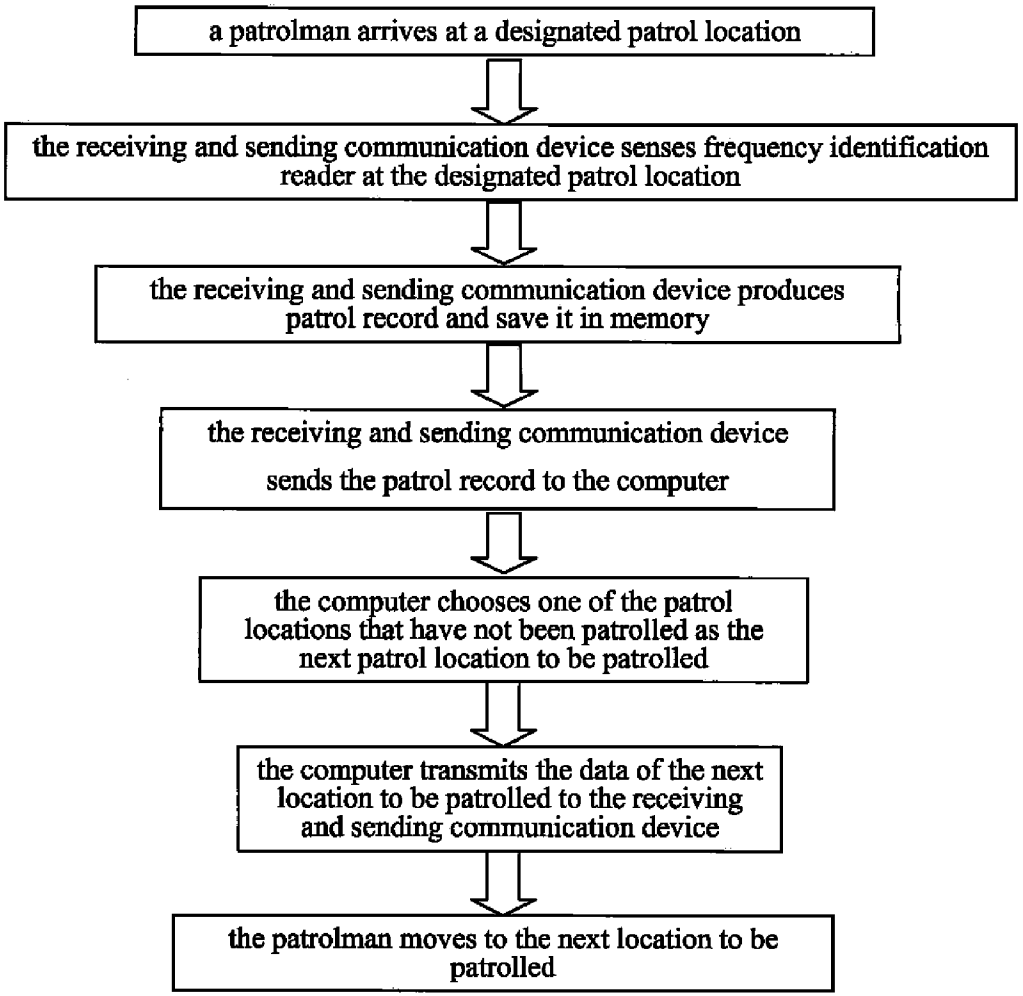
FIG. 5 is a flowchart of a patrol method in accordance with the present invention.

Once the next location to be patrolled is determined, the data of the next location to be patrolled will be transmitted to the receiving and sending communication device 21 in such a manner that the data of the next location to be patrolled is firstly received by the GSM/GPRS 213 and then transmitted to the micro controller 211, and finally displayed on the display 214 after being processed by the micro controller 211. The patrolman moves to the next patrol location according to the instruction of the computer 20, and the flowchart is as shown in FIG. 5.

The receiving and sending communication device 21 senses the frequency identification labels 22 and gives feedback to the computer 20, allowing the computer 20 to monitor the position of the patrolman. If the patrolman failed to arrive at the designated location within the predetermined time, the person in charge of the computer 20 can contact the patrolman. If the patrolman doesn't respond or something goes wrong, problems can be settled immediately.

The patrol method can change the patrol route randomly, so that the thief doesn't know the patrol route, as a result, he dare not take action. Further, every patrol location and the corresponding patrol route are determined randomly by the computer, even the patrolman doesn't know the next patrol location, thus preventing the patrolman from colluding with the thief and betraying the patrol route.

To summarize, the present invention relates to a patrol system and its patrol method. The patrol system comprises a computer, a receiving and sending communication device, and a plurality of signal elements. The computer and the receiving and sending communication device are wirelessly connected to each other. The receiving and sending communication device serves to sense the signal elements. The signal elements are disposed at designated patrol locations. The receiving and sending communication device senses the signal elements and gives feedback to the computer, allowing the computer to monitor the position of the patrolman. And the patrol route of each patrolman is determined randomly by the computer, so that the thief doesn't know the patrol route. Further, even the patrolman doesn't know the next patrol location to be patrolled, thus preventing the patrolman from colluding with the thief and betraying the patrol route.

While we have shown and described various embodiments in accordance with the present invention, it is clear to those skilled in the art that further embodiments may be made without departing from the scope of the present invention.

What is claimed is:

1. A patrol method of a patrol system, when a patrolman with a receiving and sending communication device arrives at a designated patrol location, and the receiving and sending communication device senses signal element disposed at the patrol location, the receiving and sending communication device will give feedback to a computer, and then the computer will determine next patrol location to be patrolled after receiving the feedback from the receiving and sending communication device, and will transmit data of the next patrol location to the receiving and sending communication device;

the patrol method randomly determines the next location to be patrolled based on the following principles:

A. the next location to be patrolled should be neighboring to the patrol location which is being patrolled;

B. the next location to be patrolled is allowed to be the location which has been patrolled, and the probability of patrolling the patrolled location is comparatively low and the probability of patrolling the non-patrolled locations is relatively high;

C. the probabilities of patrolling are also different from specific patrolled location to specific patrolled location, the longer the time has passed since a location was patrolled, the more likely this location is to be patrolled, and vice versa, the shorter the time has passed since a location was patrolled, the less likely this location is to be patrolled;

D. the computer is able to predetermine important patrol locations such that the important patrol locations are set to have a higher probability of patrolling than general patrol locations.

* * * * *